US010950209B1

(12) United States Patent
Greene

(10) Patent No.: US 10,950,209 B1
(45) Date of Patent: Mar. 16, 2021

(54) MULTI-PLECTRA SLEEVE SYSTEM AND METHOD OF USE

(71) Applicant: Aaron Joseph Greene, Los Angeles, CA (US)

(72) Inventor: Aaron Joseph Greene, Los Angeles, CA (US)

( * ) Notice: Subject to any disclaimer, the term of this patent is extended or adjusted under 35 U.S.C. 154(b) by 0 days.

(21) Appl. No.: 16/539,536

(22) Filed: Aug. 13, 2019

Related U.S. Application Data

(60) Provisional application No. 62/922,001, filed on Jul. 17, 2019, provisional application No. 62/921,889, filed on Jul. 12, 2019, provisional application No. 62/921,219, filed on Jun. 4, 2019, provisional application No. 62/921,072, filed on May 30, 2019.

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS 749,616 A * 1/1904 Knell ..... G10D 3/173 84/329
768,241 A * 8/1904 Seidel ..... G10D 3/173 84/322
3,304,826 A * 2/1967 Caron ..... G10D 3/173 84/322
4,248,128 A * 2/1981 Des Gaines ..... G10D 3/173 84/322
4,467,693 A * 8/1984 Nasfell, Jr. ..... G10D 3/173 84/329
4,785,708 A * 11/1988 Vaughan ..... G10D 3/173 84/329
4,890,531 A * 1/1990 Tischer ..... G10D 3/173 84/329
5,127,300 A * 7/1992 Silverman ..... G10D 3/173 84/329
5,271,308 A * 12/1993 Balog ..... G10D 3/173 84/322
5,300,730 A * 4/1994 Ekhaus ..... G10H 3/18 84/734
5,488,892 A * 2/1996 Jepsen ..... G10D 3/173 84/322
5,649,634 A * 7/1997 Irizarry ..... F16M 13/022 211/120
5,859,377 A * 1/1999 Mackey ..... G10D 3/173 84/322
6,140,564 A * 10/2000 Pia ..... G10D 3/173 84/453
6,215,052 B1 * 4/2001 Giddens ..... G10D 3/173 84/329

(Continued)

*Primary Examiner* — Robert W Horn
(74) *Attorney, Agent, or Firm* — Richard Eldredge; Eldredge Law Firm

(57) ABSTRACT

A multi-plectrum sleeve system includes a multi-plectrum sleeve, having a body extending from a first side to a second side; a first slot extending inwardly into the body; a second slot extending inwardly into the body; a first plectrum removably inserted into the first slot; and a second plectrum removably inserted into the second slot; the multi-plectrum sleeve provides for easy transitioning between the first plectrum and the second plectrum.

3 Claims, 9 Drawing Sheets

(56) References Cited

U.S. PATENT DOCUMENTS

| | | | | |
|---|---|---|---|---|
| 6,259,009 | B1 * | 7/2001 | Bolo, III | G10G 5/005 84/329 |
| 7,626,103 | B1 * | 12/2009 | Phillips | G10D 3/173 84/320 |
| 7,812,234 | B2 * | 10/2010 | Dybas | G10D 3/173 84/322 |
| 8,035,017 | B1 * | 10/2011 | Morris | G10D 3/173 84/320 |
| 8,134,059 | B2 * | 3/2012 | Zink | G10D 3/173 84/320 |
| 9,147,382 | B2 * | 9/2015 | Holm | G10H 3/00 |
| 9,361,865 | B2 * | 6/2016 | Holm | G10H 3/00 |
| 9,747,874 | B2 * | 8/2017 | Holm | G10H 1/0008 |
| 10,304,424 | B1 * | 5/2019 | Baker | G10G 5/00 |
| 2006/0225556 | A1 * | 10/2006 | Glyde | G10D 3/173 84/320 |
| 2014/0311318 | A1 * | 10/2014 | Koster | G10D 3/173 84/329 |
| 2015/0255050 | A1 * | 9/2015 | Diaz Lopez | G10D 3/173 84/322 |
| 2017/0221465 | A1 * | 8/2017 | Piccionelli | G10H 1/34 |
| 2018/0025707 | A1 * | 1/2018 | Gustafson | G10D 3/173 84/322 |

* cited by examiner

MULTI-PLECTRA SLEEVE SYSTEM AND METHOD OF USE

BACKGROUND

1. Field of the Invention

The present invention relates generally to plectrum holding systems, and more specifically, to a multi-plectra sleeve system for holding two or more plectra within the sleeve, thereby allowing for a user to easily switch between a plurality of plectra to allow a user to change which they are using without interrupting their instrument playing process.

2. Description of Related Art

Plectra, also commonly referred to as guitar/string instrument picks, are well known in the art and are effective means to play string instruments, such as guitars, basses, mandolins, ukuleles, and sitars, for generating sound. It is common for the user to have a variety of plectra based on their needs, as each provides for different thicknesses, qualities, materials, and the like. For example, FIG. 1 depicts a series of conventional plectra 101, having three options 103, 105, 107. During use, the user may select one plectrum for the entire playing time or may switch back and forth as needed for particular uses, such as for strumming as opposed to picking.

One of the problems commonly associated with system 101 is limited use. For example, the user may find it inconvenient to switch between plectra or may find it limiting to merely use one plectrum during the process.

Accordingly, although great strides have been made in the area of plectra and plectra holding systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
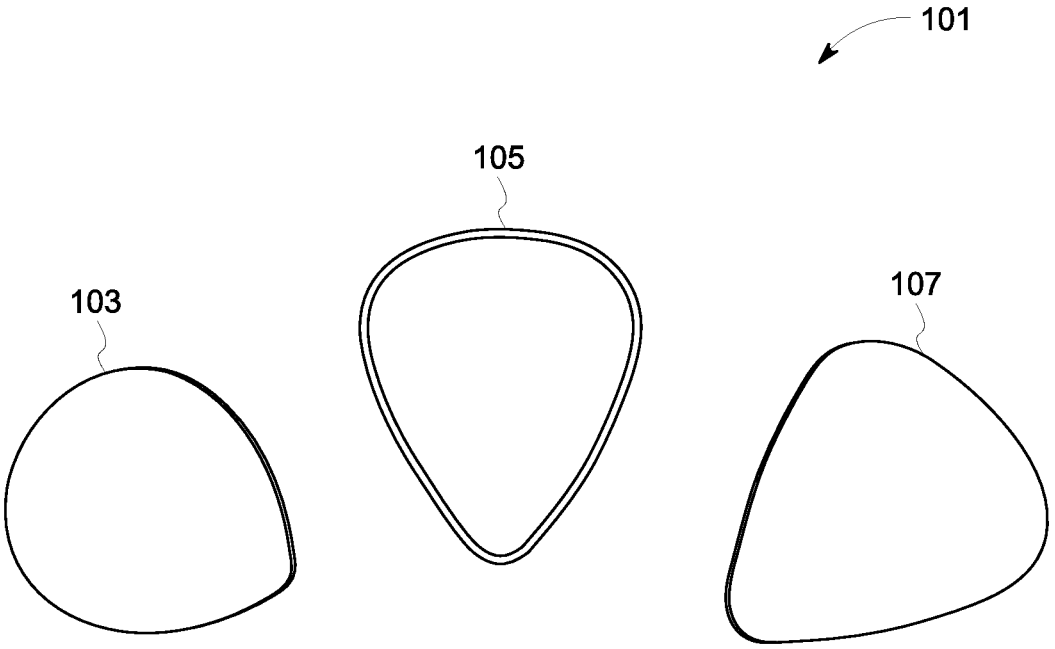
FIG. 1 (PRIOR ART)
FIG. 1 is a top view of a variety of common plectra.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional plectrum systems. Specifically, the present invention provides for a multi-plectra holding system that allows for a user to hold and use multiple plectra at once, thereby providing for a convenient means to switch between the plectra as needed. In addition, the sleeve allows for enhanced plectrum stability during instrument engagement without giving up plectrum tip of choice. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
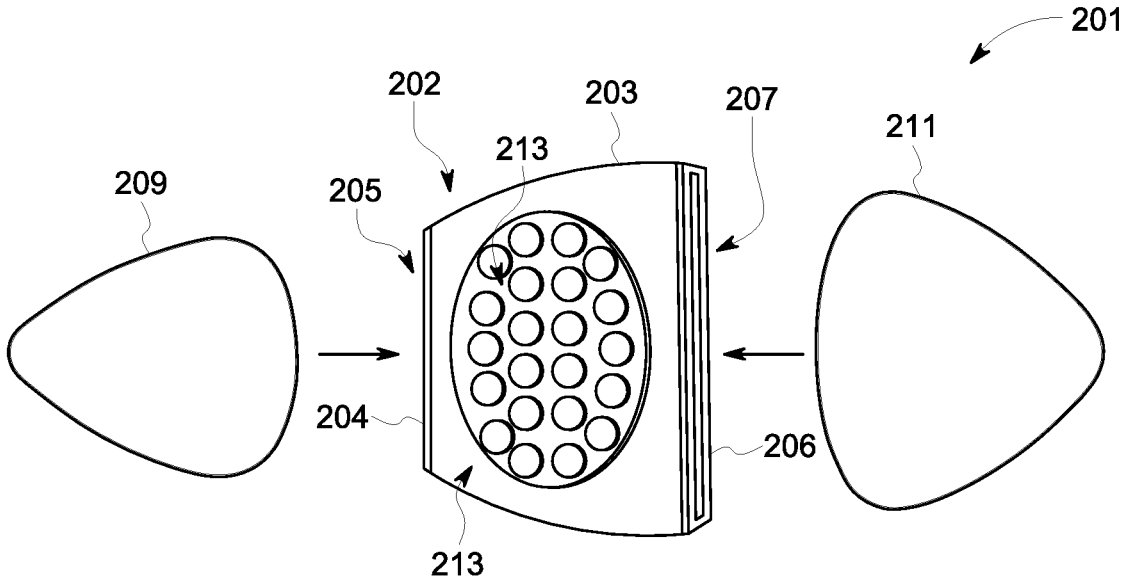
FIG. 2 is a top view of a multi-plectra holding system in accordance with a first embodiment of the present application.

Referring now to the drawings wherein like reference characters identify corresponding or similar elements throughout the several views, FIG. 2 depicts a top view of a multi-plectra holding system 201 in accordance with a preferred embodiment of the present application. It will be appreciated that system 201 overcomes one or more of the above-listed problems commonly associated with conventional plectrum systems.

In the contemplated embodiment, system 201 includes multi-plectra holding sleeve 202, having a body 203 extending from a first side 204 to a second side 206 and having a first slot 205 and a second slot 207 extending inwardly into the body. It should be appreciated, and will be discussed herein, that the shape of the body, number of slots, and materials can vary. As shown, in some embodiments a surface treatment 213 is provided on a top surface 214, which provides for improved user grip. The surface treatment 213 can consist of protrusions, adhesives, or other features that provide for a gripping surface.

It should be appreciated that the sleeve can be composed of various materials, some of the materials contemplated include plastics, polymers, metals, stones, woods, hemp, or any other material that can be molded and the like. Further, the sleeve can be manufactured through any known means, such as through 3D printing, injection molding, metallurgy, casting, masonry, alchemy, carpentry, and any other suitable method.

As shown, the body of the sleeve in the preferred embodiment is substantially flat, however, it is contemplated that the body could be non-traditional or abstract in shape in order to enhance grip, stability, ergonomics, efficiency of rotation, and comfort during use.

Figure 3:
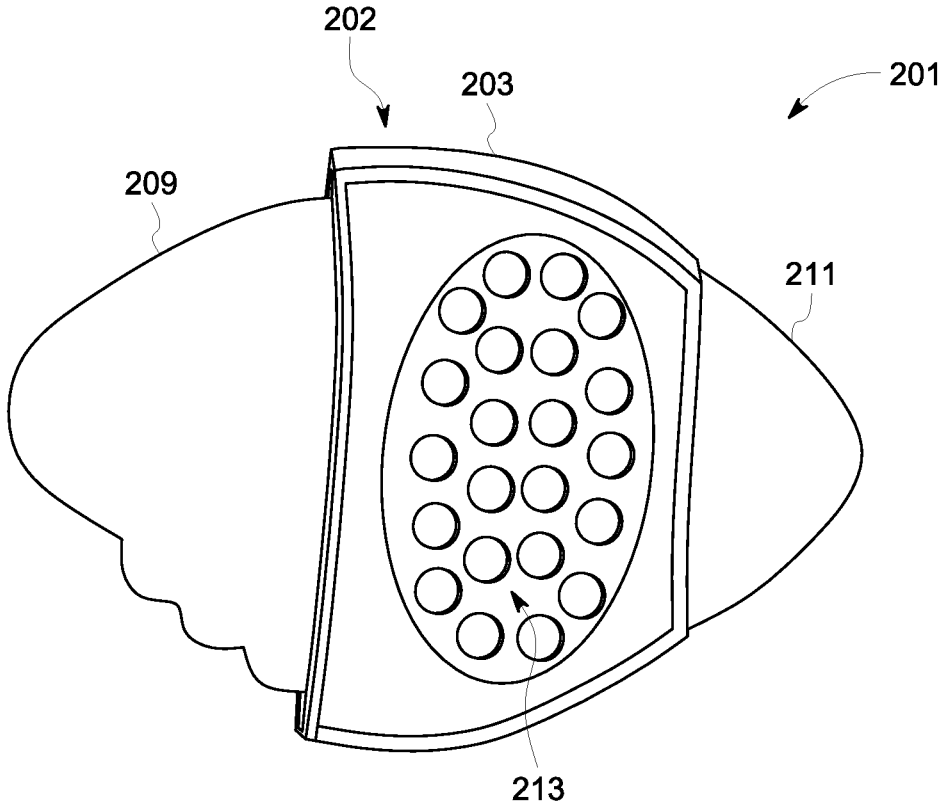
FIG. 3 is a top view of the system of FIG. 2 with a first plectrum and second plectrum engaged.

As shown in FIGS. 2 and 3, system 201 further includes a plurality of plectra 209, 211, which can vary in size, materials, shape, features, sizes, and producers wherein the plectra 209 are removably secured within the slots. It should be appreciated and understood that the plectra can be inserted into the slots at any end, such as the string plucking end or the gripping end. Some plectra may fit in such a way so as to overlap within an internal cavity created by way of some slots running through a given variation of the apparatus and meeting internally. Further, the slots may include textured surfaces to aid in grip.

It should be appreciated that one of the unique features believed characteristic of the present application is the ability to secure a plurality of plectra together within the plurality of slots, thereby providing for a single device that a user can use to easily switch between plectra as needed. The sleeve facilitates rapid and efficient transitioning between various user selected plectra for individual use in real time, expanding tonal options while enhancing grip through material and texture, providing a consistent gripping surface despite shape, size, and material of the inserted plectra.

The present invention further provides for additional benefits, including control of the plectrum. The sleeve provides for a means to easily allow the user to squeeze/pinch the plectra resulting in improved gripping, leverage, and ergonomics. Further, the present invention adds mass to the plectra which can change the acoustics associated with the plectra.

In FIGS. 4-8, exemplary embodiments of various shapes and configurations of the system of the present invention are shown. It should be appreciated that these embodiments are provided for example, and alternative shapes and numbers of slots could be easily incorporated or added based on the teachings of this application.

Figure 4:
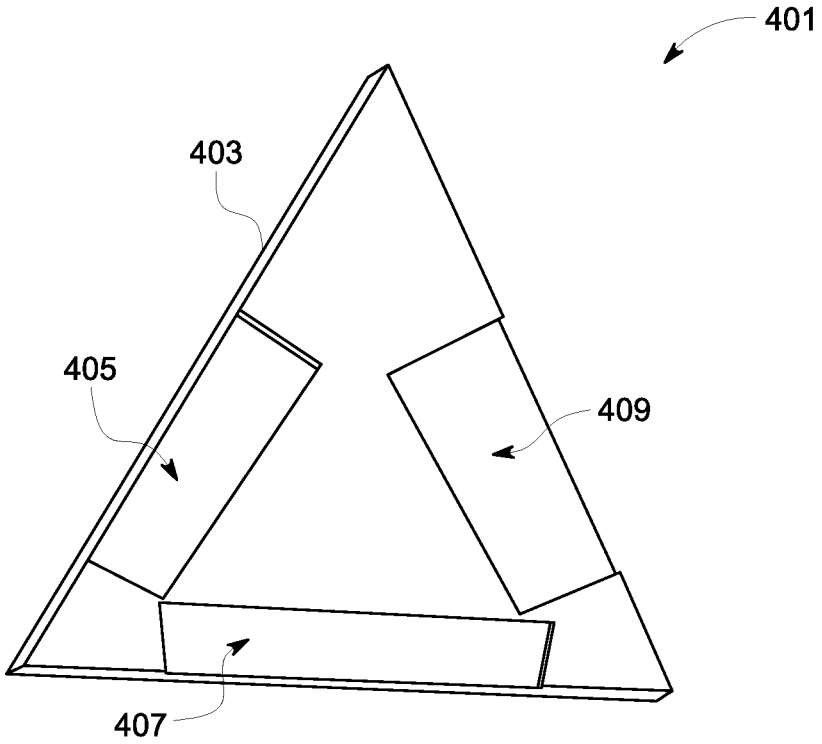
FIG. 4 is a top schematic of a second embodiment of a portion of a multi plectra holding sleeve in accordance with the present invention.
Figure 5:
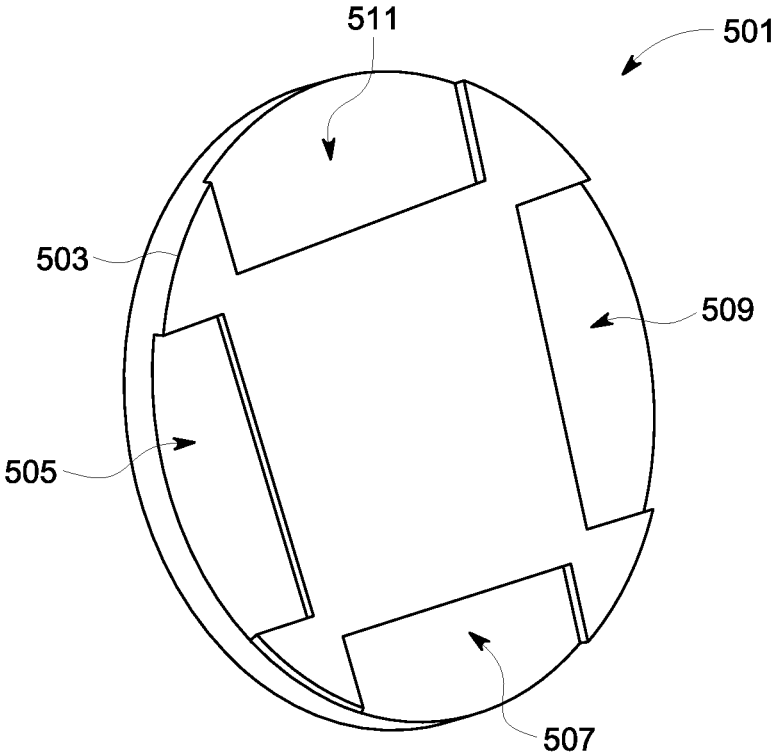
FIG. 5 is an isometric view of a third embodiment of a portion of a multi-plectra holding sleeve in accordance with the present invention.
Figure 6:
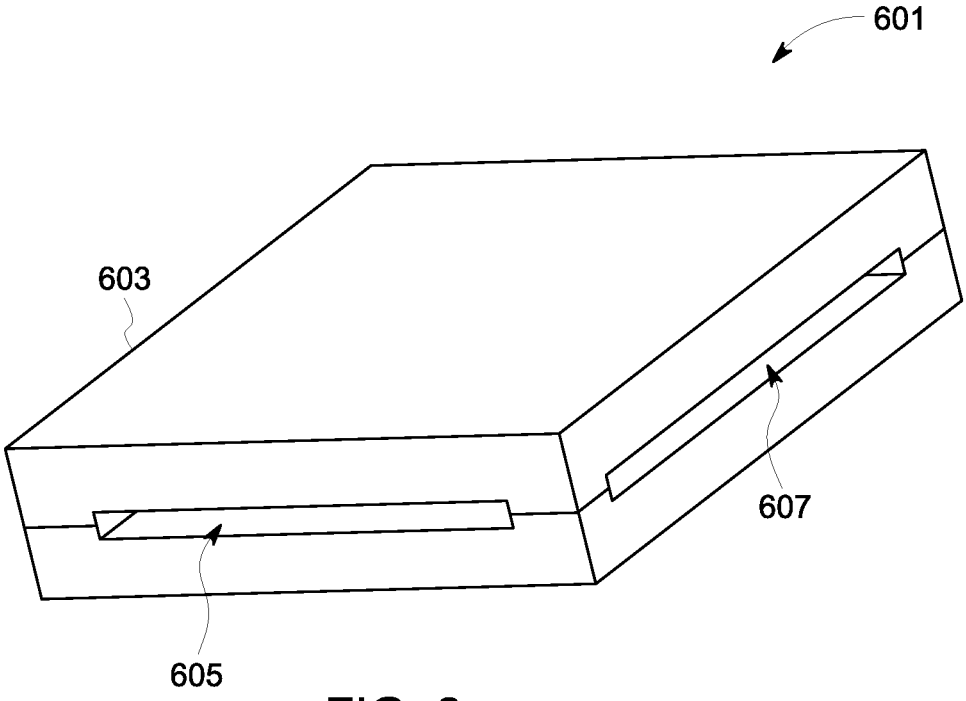
FIG. 6 is an isometric view of a fourth embodiment of a multi-plectra holding sleeve in accordance with the present invention.

In FIG. 4, an embodiment 401 is shown, wherein the body 403 (only a bottom portion shown for clarity) is triangular in shape and includes three slots 405, 407, 409 thereby providing for an embodiment suitable for three plectra. In FIG. 5, an embodiment 501 is shown, wherein the body 503 (only a bottom portion shown for clarity) is cylindrical and includes four slots 505, 507, 509, 511. In FIG. 6, an embodiment 601 is shown, having a rectangular body 603 with a plurality of slots 605, 607.

Figure 7:
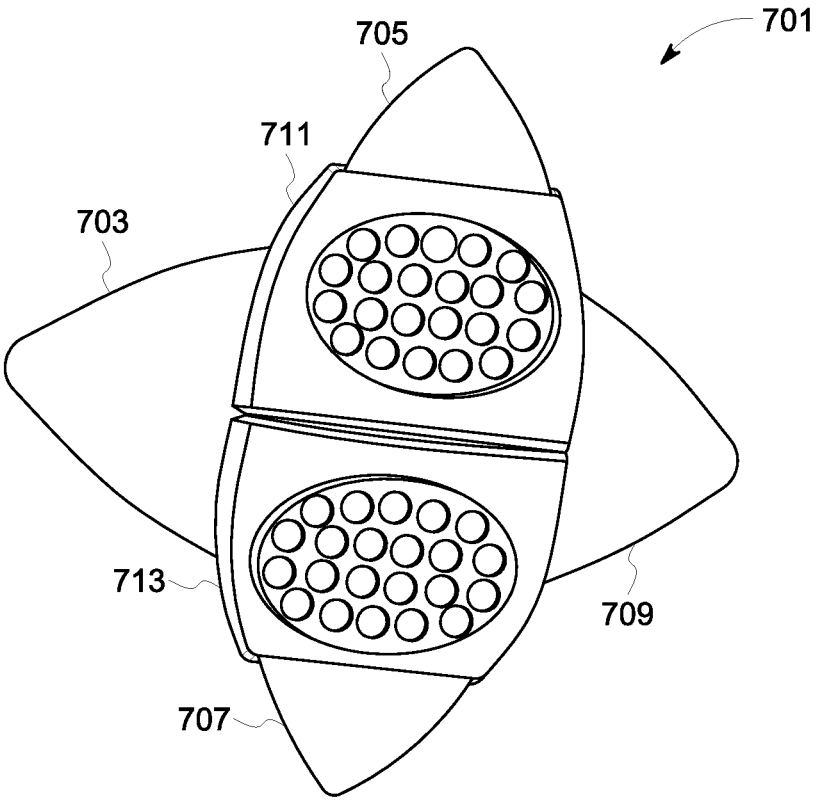
FIG. 7 is a top view of a fifth embodiment of a multi-plectra holding sleeve in accordance with the present invention.
Figure 8:
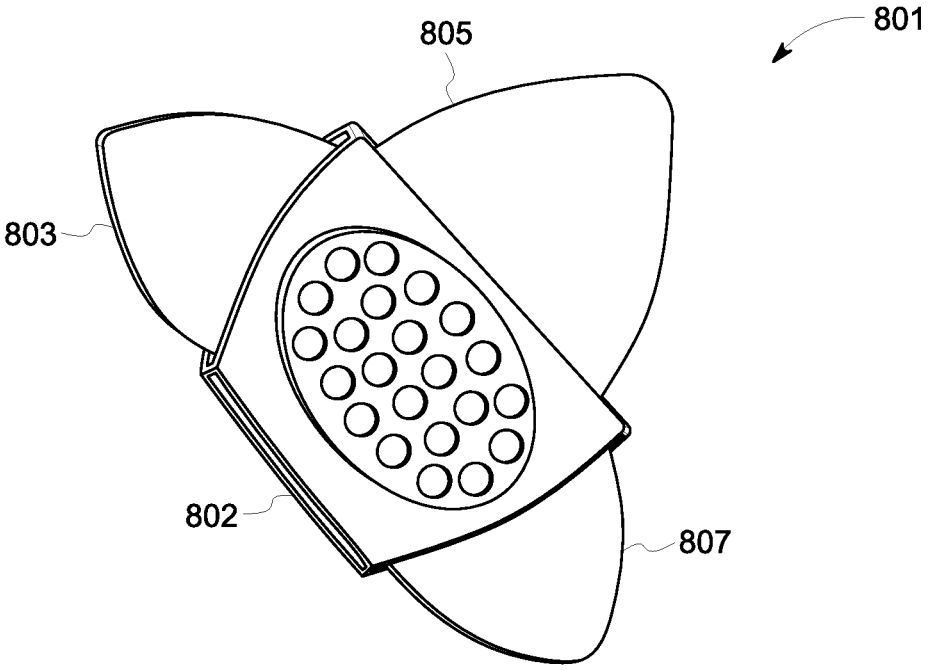
FIG. 8 is a top view of a sixth embodiment multi-plectra holding sleeve in accordance with the present invention.

In FIG. 7, an embodiment 701 is shown, wherein four plectra 703, 705, 707, 709 are secured together with two sleeves 711, 713. It should further be appreciated that a fifth plectra (not shown) can be positioned between the two sleeves, thereby securing the sleeves together. In FIG. 8, an embodiment 801 is shown, wherein the sleeve 802 is adapted to receive at least three plectra 803, 805, 807.

Figure 9:
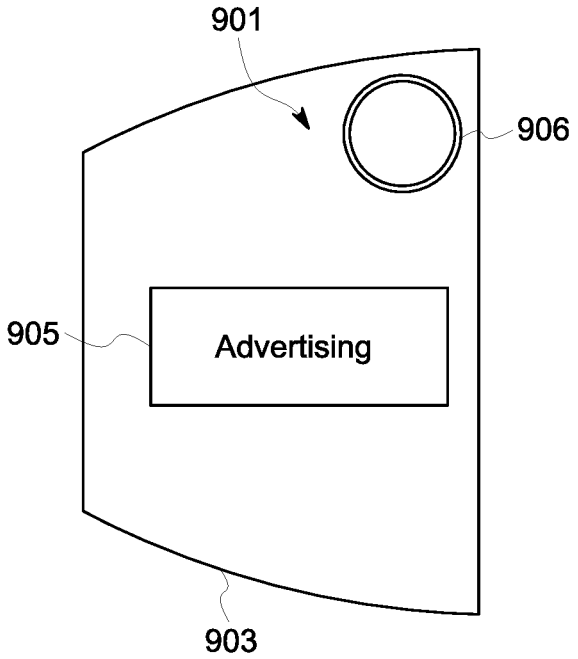
FIG. 9 is a top view of an alternative embodiment of a body of a multi-plectra holding sleeve in accordance with the present invention.

In FIG. 9, a top view depicts alternative features contemplated. As shown, embodiment 901 can include an advertisement 905 printed on a top surface 901 of the sleeve 903. It should be appreciated that alternative embodiments can further include a suction cup 906 or another securement device configured to secure the sleeve to an instrument or other surface.

As will be discussed herein, the slots may vary between embodiments, wherein the slots may exhibit different degrees of flexibility due to the material, may be tapered, may vary in lengths, and can vary in various other features.

Figure 10:
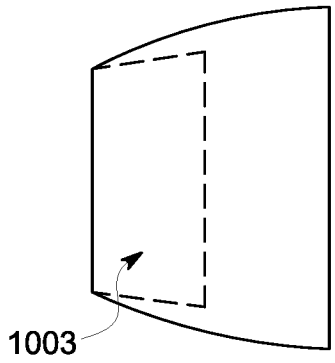
FIGS. 10, 11, and 12 are top views depicting alternative shapes of slots associated with the present invention.
Figure 11:
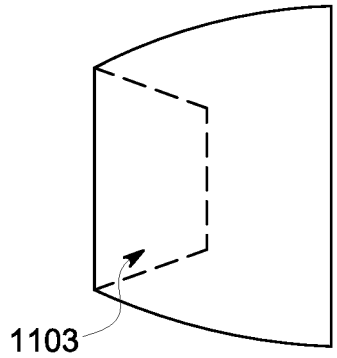
Figure 12:
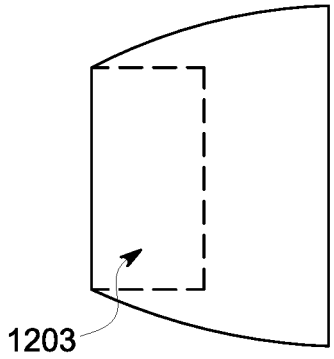

In FIGS. 10, 11, and 12, top simplified views depict various shapes associated with any of the slots 1003, 1103, 1203 of the present invention. As shown, the slots may be even from a front to back in thickness, or may taper in either direction, thereby providing for various securing features associated with the slots.

Figure 13:
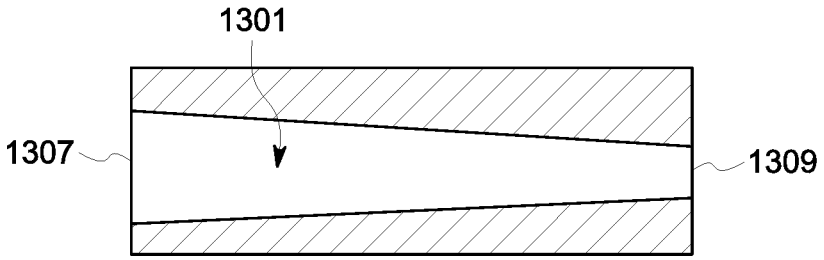
FIGS. 13, 14, and 15 are side cross-sectional views of alternative shapes of slots associated with the present invention.
Figure 14:
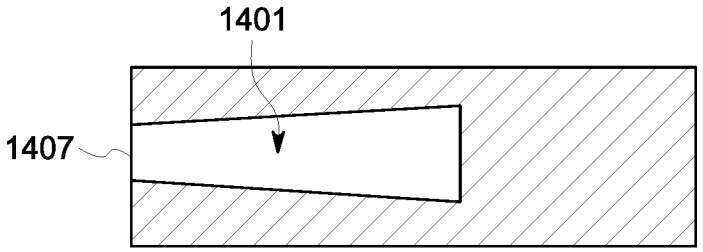
Figure 15:
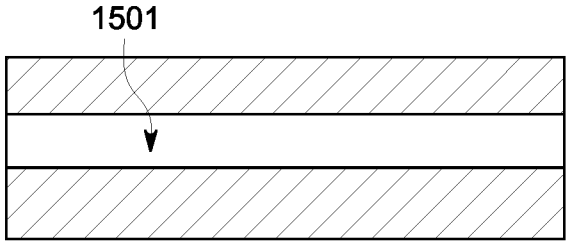

In FIGS. 13, 14, and 15, side cross sectional views depict various depths associated with any of the slots 1301, 1401, 1501 of the present invention. As shown, the slots may have a constant depth throughout or may taper in either direction, and/or from a first side to a second side. Further, as shown, the slots may extend from a first side 1307 to a second side 1309 or may only extend partially into the interior of the body 1403 from the first side 1407.

Figure 16:
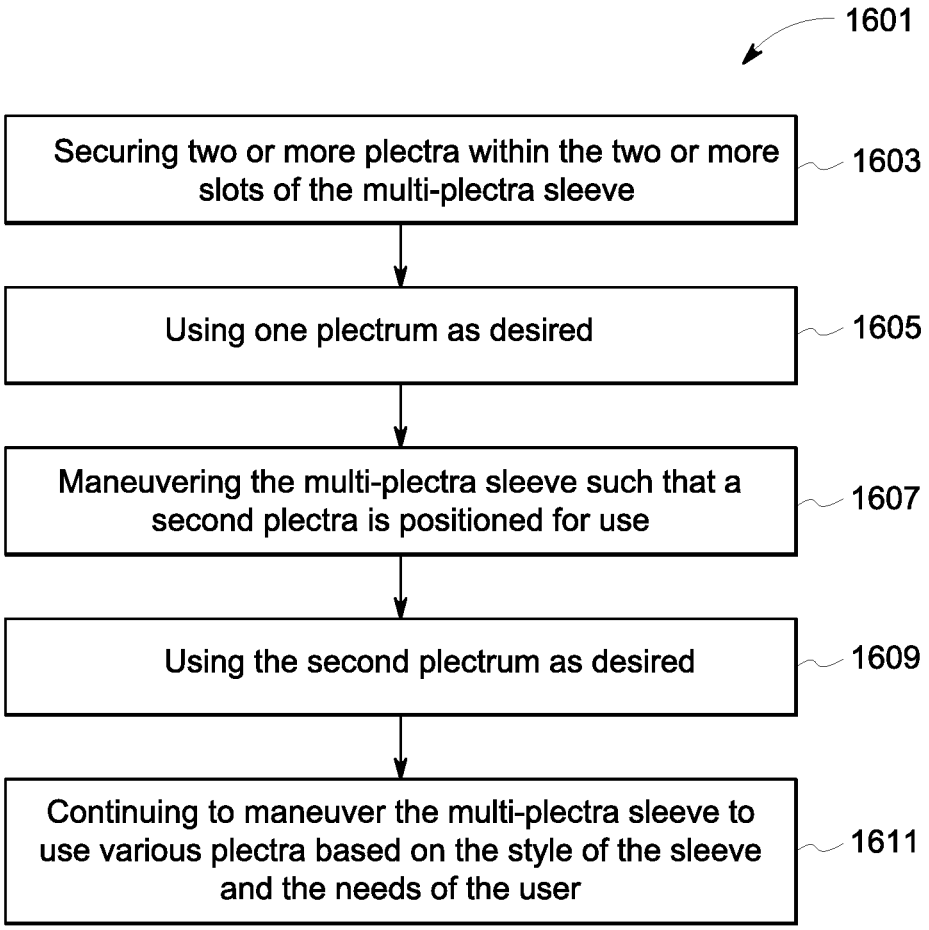
FIG. 16 is a flowchart of a method of use of the system of the present invention.

In FIG. 16, 1601 depicts a flowchart of the method of use of the present invention. During use, the user will secure a plurality of plectra within a sleeve, as shown with box 1603. The user can then proceed to play an instrument with one plectrum and use the sleeve to switch to second, third, fourth, etc. plectrum as desired, as shown with boxes 1605, 1607, 1609, 1611.

It should be appreciated that the user can transition between plectra during active use, including, but not limited to, rotating at the center of the body of the apparatus over and/or between fingers of one hand about the horizontal or vertical axes while remaining within the user's grasp. Methods of transition enable continued use within one hand, and without releasing or reconfiguring any of the plectra within the apparatus.

Figure 17:
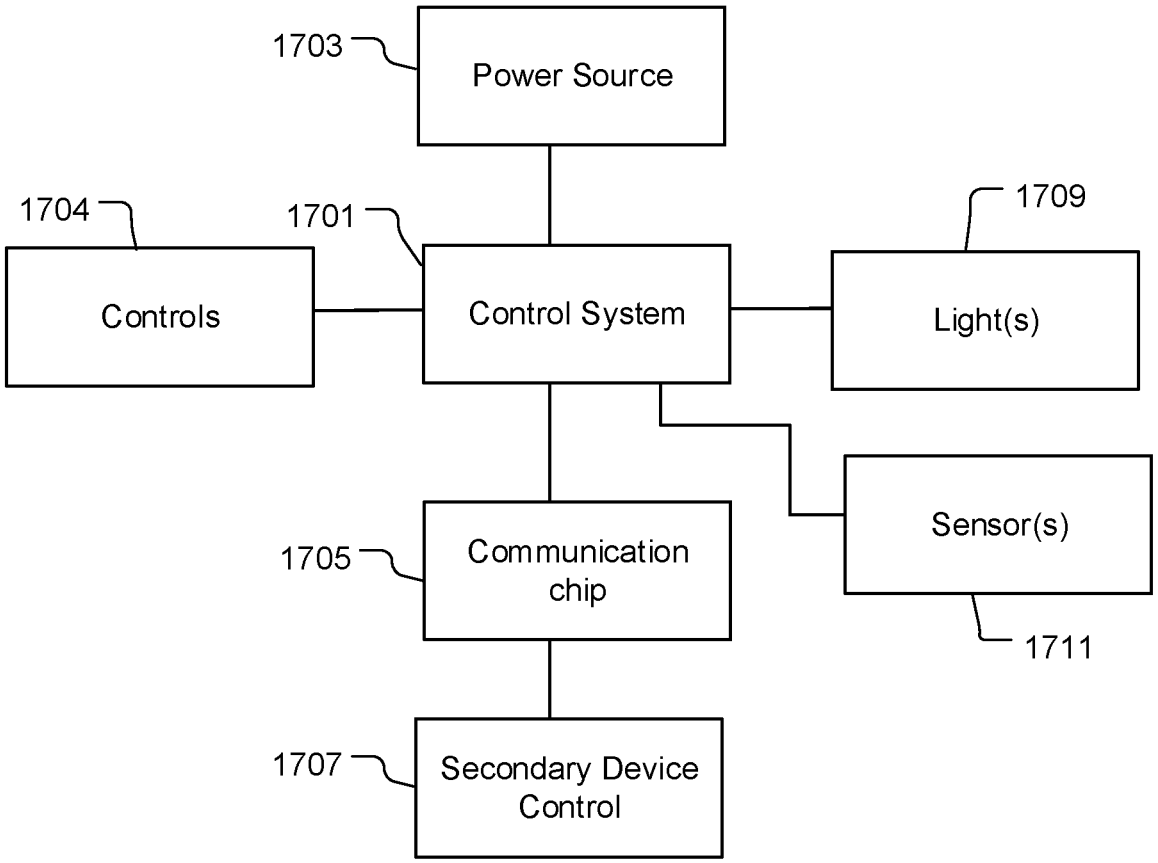
FIG. 17 is a schematic of a control system that can be incorporated into a multi-plectra sleeve in accordance with the present application.

In FIG. 17, a schematic depicts a control system 1701 that can be incorporated into any of the embodiments as would be known in the art. The control system 1701 can include a power source 1703 such as one or more batteries or the like and can further include one or more controls 1704 such as buttons, switches, knobs or the like. It is contemplated that the control system 1701 can further include one or more communication chips 1705, wherein the communication chip can be Bluetooth enabled, WIFI enabled, or utilize other technology to allow for communication with secondary devices 1707 for user control. For example, the user can control lights, sounds, or the like such as during a live performance. Further, it is contemplated that the control system 1701 can include one or more lights 1709 that allow for the user to utilize the multi-plectra sleeve as a flashlight or for providing an aesthetical improvement. Yet further, it is contemplated that the control system can include various sensors 1711, such as motion and light sensors.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A multi-plectrum sleeve system, comprising:

a multi-plectrum sleeve, having:

a body for gripping, extending from a first side to a second side;

a first slot in the first side, extending inwardly into the body;

a second slot in the second side, extending inwardly into the body;

a first plectrum removably inserted into the first slot, leaving the picking point exposed;

a second plectrum removably inserted into the second slot, leaving the picking point exposed, the second plectrum picking point pointing in a different direction than the first plectrum picking point;

wherein the multi-plectrum sleeve provides for grip to the first plectrum inserted within the first slot and the second plectrum inserted within the second slot;

wherein use of the multi-plectrum sleeve with a musical instrument provides for easy transitioning between engaging the musical instrument with the first plectrum picking point and the second plectrum picking point separately.

2. The system of claim 1, wherein the first slot and second slot are connected within the body to allow for the non-picking ends of the inserted plectra to make direct contact with one another and overlap within the body.

3. A method of using multiple plectra with a musical instrument, the method comprising:

providing a multi-plectra sleeve having a body for gripping, with a first slot extending into the body from a first side and a second slot extending into the body from a second side;

securing a first plectrum within the first slot, leaving the picking point exposed;

securing a second plectrum within the second slot, leaving the picking point exposed, the second plectrum picking point pointing in a different direction than the first plectrum picking point;

using the first plectrum picking point with the musical instrument; and rotating the multi-plectra sleeve such that the second plectrum picking point can be used with the musical instrument separately from the first plectrum picking point.

* * * * *